US005106026A

United States Patent [19]

Baron

[11] Patent Number: 5,106,026

[45] Date of Patent: Apr. 21, 1992

[54] RECYCLING APPARATUS FOR DISINTEGRATING DISCARDED CONTAINERS

[76] Inventor: Kyle L. Baron, 5260 S. Maryknoll Dr., New Berlin, Wis. 53151

[21] Appl. No.: 582,361

[22] Filed: Sep. 14, 1990

[51] Int. Cl.[5] ..... B02C 19/14

[52] U.S. Cl. ..... 241/99; 241/100; 241/206; 241/253

[58] Field of Search ..... 241/99, 100, 260.1, 241/200, 202, 204, 205, 206, 224, 245, 251, 253, 257 R, 265, 266, 225, DIG. 38; 100/902

[56] References Cited

U.S. PATENT DOCUMENTS

| | | | |
|---|---|---|---|
| 3,504,621 | 4/1970 | Qualheim | 241/99 X |
| 3,827,351 | 8/1974 | Rosenow | 241/99 X |
| 3,951,059 | 4/1976 | Morris | 241/99 X |
| 3,991,944 | 11/1976 | Baikoff | 241/224 X |

FOREIGN PATENT DOCUMENTS

| | | | |
|---|---|---|---|
| 2221405 | 2/1990 | United Kingdom | 241/99 |

*Primary Examiner*—Mark Rosenbaum
*Attorney, Agent, or Firm*—Andrus, Sceales, Starke & Sawall

[57] ABSTRACT

An apparatus, suitable for household use, for cutting and breaking empty discarded frangible containers into small pieces of material to facilitate subsequent processing and recycling of those materials. The apparatus includes a manually operable loading bin for dumping containers (glass or plastic bottles and jars, metal cans, small cardboard boxes, etc.) into the wide upper inlet opening of a conical chamber. Motor-driven rotatable circular cutting blades, having sharp edges which project into the chamber through slots in the chamber wall, cut and break the containers descending through the chamber into small pieces of material (glass, plastic, metal, cardboard, etc.). The pieces exit the narrow lower outlet opening of the chamber into a selected one of several compartments in an adjustably positionable carousel below the outlet opening. The slots (and blade edges projecting therethrough) are arranged in three radially spaced apart vertical columns around the chamber wall. The slots in each column are vertically spaced apart. The cuttingh blades in each column are rigidly mounted in vertically spaced apart, eccentric relationship on a drive shaft mounted exteriorly of the chamber. One shaft is motor driven and drives the other two shafts through a pinion/ring gear mechanism. Containers descending through the chamber are squeezed, scored, cut and broken between the sharp edges of the cutting blades and the opposing cutting blades or opposing wall surfaces.

9 Claims, 2 Drawing Sheets

RECYCLING APPARATUS FOR DISINTEGRATING DISCARDED CONTAINERS

BACKGROUND OF THE INVENTION

This invention relates generally to apparatus for disintegrating (i.e., cutting and breaking) empty discarded frangible containers into small pieces of material to facilitate subsequent processing and recycling of those materials, and in particular, to apparatus suitable for use in a household to cut and/or break up glass or plastic bottles and jars, metal cans, and plastic or cardboard boxes of the type in which household products are packaged.

Various kinds of food and household products are packaged in small and medium-sized containers made of the aforesaid materials. A typical household is faced with the problem of disposing of a relatively large quantity of such containers, as well as other waste products, on a daily basis. It is economically desirable to salvage and recycle re-usable materials such as glass, metal, plastic and cardboard from which various products are made. However, the task of manually disintegrating these containers into small pieces which can be easily packaged and delivered to recycling centers is messy, discouraging and dangerous. It is desirable, therefore, to provide apparatus suitable for use in a household which is capable of automatically and safely cutting and breaking discarded containers of the aforesaid type into relatively small pieces of material which are easily packaged and transported to recycling centers.

Presently, only general trash compactors and metal can crushers appear to be commercially available for household use. However, trash compactors merely crush a mixed variety of organic (garbage) and otherwise reusable materials for disposal in a landfill or incinerator and do not facilitate recycling of reusable materials. On the other hand, can crushers (manually or electrically operated) are specifically designed to process metal cans and cannot be efficiently and safely used to process glass, plastic or cardboard containers.

For commercial processing of waste and salvage of reusable materials there are available certain large and expensive machines, as shown in the following patents. Hannigan et al, U.S. Pat. No. 4,852,817, discloses apparatus for breaking up containers filled with food. The Tipton patent, U.S. Pat. No. 4,830,188 shows a machine for separating plastic fragments from broken containers by flotation. Other patents such as U.S. Pat. Nos. 4,784,340; 4,632,317; 4,040,571; European Patent No. 0 234 337 and West German Patent No. 3704713 relate to shredders for organic waste. All of the aforementioned patents employ one or more horizontally-disposed helical screws to process material. None is similar in purpose, size, construction or mode of operation to applicant's invention hereinafter described.

SUMMARY OF THE INVENTION

The apparatus, suitable for household use, comprises a manually operable loading bin for dumping discarded empty containers (glass or plastic bottles and jars, metal cans, small cardboard boxes, etc.) into the wide upper inlet opening of a conical chamber. Motor-driven rotatable circular cutting blades, having sharp edges which project into the chamber through slots in the chamber wall, cut and break the containers descending through the chamber into small pieces of material (glass, plastic, metal, cardboard, etc.). The pieces exit the narrow lower outlet opening of the chamber into a selected one of several components in an adjustably positionable carousel below the outlet opening. The slots (and blade edges projecting therethrough) are arranged in three radially spaced apart vertical columns around the chamber wall. The slots in each column are vertically spaced apart. The cutting blades in each column are rigidly mounted in vertically spaced apart, eccentric relationship on a drive shaft mounted exteriorly of the chamber. One shaft is motor driven and drives the other two shafts through a pinion/ring gear mechanism. Containers descending through the chamber are squeezed, scored, cut and broken between the sharp edges of the cutting blades and the opposing cutting blades or opposing wall surfaces.

The invention offers several important advantages over the prior art. For example, it is designed and sized so as to be suitable for household use. It can process a wide variety of containers typically used to package foods and household products, including bottles, jars, cans and boxes made of glass, plastic, metal and cardboard. It cuts and breaks these containers into small pieces which can be conveniently packaged for transport to recycling centers. It is provided with several safety features which protect the operator from injury while using the apparatus. It is easy to use, reliable in use, easy to repair and service, and economical to manufacture.

Other objects and advantages will become apparent hereinafter.

DESCRIPTION OF A PREFERRED EMBODIMENT

Figure 1:
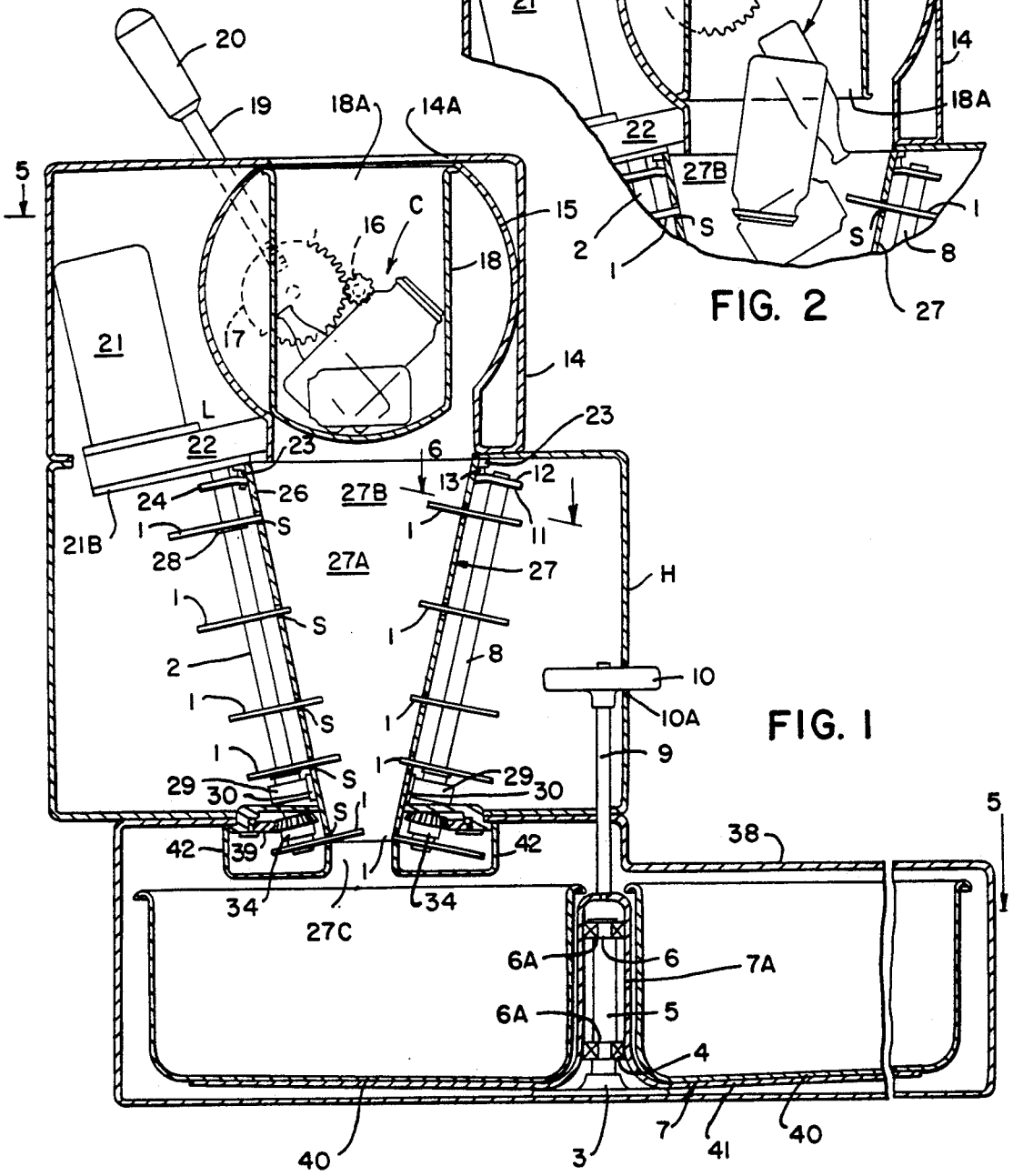
FIG. 1 is a side elevational view, partly in cross-section, of one embodiment of apparatus in accordance with the present invention.
Figure 5:
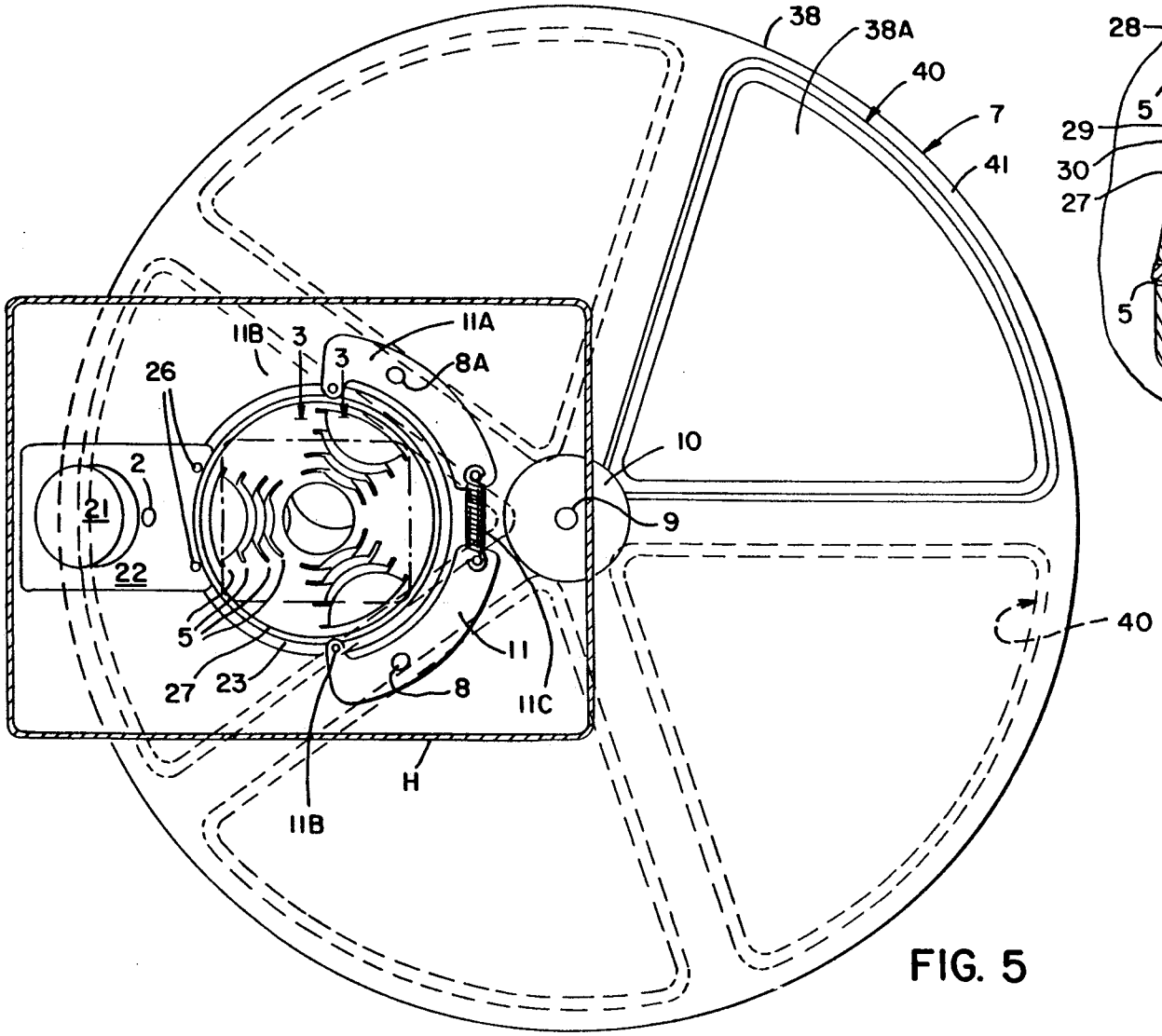
FIG. 5 is a top plan view, partly in cross-section taken generally along line 5—5, of the apparatus shown in FIG. 1.

Referring to FIGS. 1 and 5, apparatus in accordance with the present invention generally comprises a stationary sheet metal housing assembly for supporting and shielding the components of the apparatus. The housing assembly, which is preferably fabricated of sheet metal, comprises a carousel housing 38 having an opening 38A (FIG. 5), a cone housing H, a material entry housing 14 having an opening 14A and a bin housing 15 within the latter housing. The components include a rotatable container loading bin 18; means to effect manual rotation thereof; a stationary cone 27 having a cone-shaped, horn-shaped, or otherwise tapered chamber 27A for receiving containers C to be processed through its upper inlet opening 27B from the loading bin 18; a plurality of (15) rotatable shaft-mounted cutting blades 1 mounted on three shafts 2, 8 and 8A (FIG. 5) and extending through a corresponding number of slots S in the cone wall into the chamber 27A; means for rotating the blades 1; a rotatable carousel 7 having a plurality of five removable material-receiving bins 40 thereon; and means to effect selective manual rotation of the carousel 7 to place the bins 40 beneath the lower outlet opening 27C of the chamber 27A.

Figure 2:
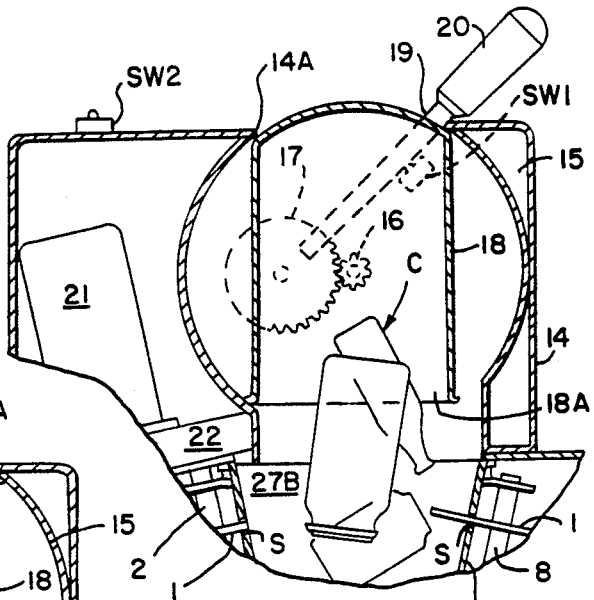
FIG. 2 is a side elevation view, partly in cross-section, of the upper portion of the apparatus of FIG. 1 and shows the loading bin thereof in an alternate operating position.

Referring to FIGS. 1 and 2, the rotatable loading bin 18 has a single opening 18A. This loading bin 18 is rotatably mounted within bin housing 15 and is adapted, when positioned as shown in FIG. 1, to receive containers C to be processed. When positioned as shown in FIG. 2, bin 18 operates to dump the containers C into chamber 27A through opening 27B.

As FIGS. 1 and 2 show, the means to effect rotation of loading bin 18 between its two positions comprises a small bin rotation gear 16 rigidly secured to a side of bin 18 and a larger bin rotation gear 17 meshed therewith. Rotation gear 17 is rotatable with respect to housing 14 by means of a gear control shaft or lever 19, which may have a handle or knob 20. These two gears 16 and 17 are sized so that lever 19 need only be swung through 45° to cause bin 18 to revolve 180°, as a comparison of FIGS. 1 and 2 will show. Bin 18 is sized so that containers C of the size and shape of a plastic one-gallon milk jug, for example, or smaller can enter and exit the opening 18A. When lever 19 is moved to rotate bin 18 to dump position (FIG. 2), the containers C fall into chamber 27A to be cut and broken by the cutting blades 1. At the same time, as FIG. 2 shows, the bottom of bin 18 blocks the upper opening 14A in material entry housing 14 so as to protect the operator of the apparatus from inserting a hand or other body part into the cutting area. Such closure also prevents fragments of material from being flung out of the apparatus through opening 14A. When lever 19 is so moved, it actuates an electric safety switch SW1. This safety switch SW1 is connected to and controls a motor 21, although it does not start the motor. Rather, safety switch SW1 merely enables the motor 21 to be started by another switch SW2.

The cone 27 is preferably fabricated from sheet steel, most preferably stainless steel, and defines chamber 27A which is generally tapered, being wider at the top than at the bottom. The cross section of cone 27 may be round, or some other geometrical shape, such as hexagonal. Cone 27 has upper container inlet opening 27B and lower material discharge or outlet opening 27C. The sidewall of cone 27, which is preferably sloped at an angle of about 12° from the vertical, is provided with the slots S therethrough to enable the sharp edge portions 1A (see FIG. 3) of the cutting blades 1 to extend or project into chamber 27A. When in operation, these cutting blades 1 cut and break containers C descending through the chamber into smaller pieces (not shown). The function of cone 27 is to hold and direct the containers C in the paths of the cutting blades 1 and to guide the pieces or fragments of material through outlet opening 27C into a selected one of the bins 40. In the embodiment shown in FIG. 5 the slots S are arranged in three sets, such as three radially spaced apart vertical columns. In this embodiment the five slots S in each column are vertically spaced apart, one above another.

The cone 27 is supported on and in the cone housing H by a cone ridge ring 23 which is secured, such as by welding, to the upper end of the cone and removably secured, such as by four bolts 26, to the cone housing H.

Referring to FIGS. 1, 4, 5 and 6, three cutting blade units are provided, one unit for each column of slots S. Each unit generally comprises a steel blade shaft 2, 8 or 8A, a plurality of five cutting blades 1 rigidly secured to a respective blade shaft, and means for rotatably mounting the respective blade shaft exteriorly of cone 27. The three shafts are radially spaced apart 120 . In the preferred embodiment the means for securing each cutting blade 1 to its respective shaft comprises a conventional tapered screwed-down flange 28 and a plurality of screws (not shown) which secure the flange to the cutting blade 1. Shaft 2 is directly driven by an electric motor 21 and its associated reducing means 22. This reducing means 22 may be a belt-and-pulley arrangement, or alternatively a reducing gear arrangement. Shafts 8 and 8A are driven from shaft 2 by a pinion gear/ring gear arrangement hereinafter described. Shaft 2 rotates about a fixed axis, whereas the rotatable shafts 8 and 8A are pivotally movable by a small amount, as hereinafter explained, to help avoid jamming and stalling.

More specifically, the upper end of shaft 2 is journaled in and rotatably supported by a fixed shaft support bracket 24 attached to cone 27. The lower end of each shaft 2, 8 and 8A is journaled in a spherical bearing 29 which, in turn, is pivotally supported by a bearing spacer 30 welded to the exterior of the lower end of cone 27.

The pivot mounted shafts 8 and 8A are each able to pivot a small amount relative to movable upper support plates 11 and 11A, respectively, to help avoid jamming and stalling. The upper support brackets 11 and 11A each support a bronze, plastic or composite bushing-type bearing 12 in which the upper ends of the shafts 8 and 8A are rotatably mounted. Each plate 11 and 11A is able to pivot in a horizontal plane about a mounting bolt 11B which secures the plate to housing H. A helical compression spring 11C is connected between the plates and operates to resiliently bias them into proper position. Spacers 13 hold the plates downwardly in a position low enough to keep the plates inside housing H.

The means for rotatably driving the three cutter blade shafts 2, 8 and 8A to effect rotation of the blades 1 thereon comprises an electric motor 21 connected to a reducing means 22, which is in turn attached to ridge ring 23. The output shaft of reducing means 22 is coupled to and drives cutter blade shaft 2, shown at the left in FIGS. 1 and 5.

Figure 4:
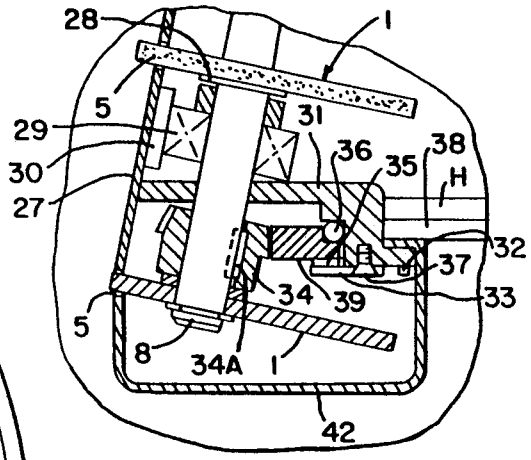
FIG. 4 is an enlarged cross-sectional view of the lower end of one of the cutting blade shafts shown in FIG. 1.
Figure 6:
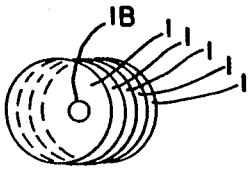
FIG. 6 is a top plan view taken generally along line 6—6 of FIG. 1 and shows the eccentric mounting arrangement of the cutting blades on a cutting blade shaft.

Each cutter blade shaft 2, 8 and 8A is provided at its lower end with a pinion gear 34 which is keyed thereto by a key 34A (FIG. 4) and set-screw (not shown). As FIGS. 1 and 4 show, a ring gear 39 is meshed with the three pinion gears 34 and transfers motion from the motor-driven shaft 2 (left in FIG. 1) to the other two shafts 8 and 8A. As FIG. 4 best shows, the ring gear 39 is supported between ball bearings 36 and a thrust plate 35 which is secured by a bearing cap 33 and a flat-head screw 37. A lower gear housing 31, which may be fabricated of aluminum and which is secured to housing 38 by bolts 32, has a bearing race for the ball bearings 36 and clearance space for the pinion gears 34 and ring gear 39.

Each cutting blade 1 is, for example, about four inches in diameter and has an arbor hole 1B (FIG. 6) offset from center by ¾" so that the blades are eccentrically disposed on a respective shaft 2, 8 and 8A. The five blades 1 on a shaft are oriented at different radial angles necessary to achieve rotational balance. A lower blade shield 42 is provided to prevent pieces of material in a bin 40 from contacting the lower blades 1 and also helps guide the small pieces that fall from the cone 27 into the bins 40.

Figure 3:
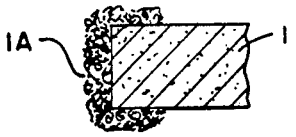
FIG. 3 is a greatly enlarged cross-sectional view taken generally along line 3—3 of FIG. 5 and shows the cutting edge of a cutting blade of the apparatus.

As FIG. 3 shows, in the most preferred embodiment each blade 1 is coated around its peripheral edge with a bonded coating 1A of tungsten carbide or ceramic grit which provides a sharp cutting edge capable of scribing and cutting containers C made of the aforedescribed materials. Thus, the blades 1 have no teeth which can dull, blunt, chip or break.

As FIGS. 1 and 5 show, carousel 7 is preferably provided with means for supporting it on and within carousel housing 38. Carousel 7 has material collection bins 40 removably mounted thereon, and is provided with means to effect manual rotation of the carousel. More specifically, carousel housing 38 supports a steel carousel shaft base 3 on which vertical steel carousel shaft 5 is mounted. Carousel shaft 5 supports a lower carousel bearing 4 and an upper carousel bearing 6, each held in place by a snap ring (not shown), which holds the respective bearing 6 against a shoulder 6A cut on the shaft. Bearings 4 and 6, which can withstand both thrust and radial loading, are located within and frictionally engage an upwardly extending tubular member 7A, integrally formed at the center of the circular steel base 41 of rotatable carousel 7. As shown in FIG. 1, base 41 slopes upwardly about 1° from the horizontal in all directions from its center. This base 41 provides support for the bins 40 which are arranged in a circle (FIG. 5). Each bin 40 may be used to receive a different material, or to increase the overall storage capacity of the apparatus over a single, non-rotatable bin. In the former usage, each bin 40 is rotated under the outlet 27C of cone 27 when a specific material is being shredded. The bottom of each bin 40 slopes upwardly about 1° (see FIG. 5) so the bin will tend to stay toward the center of carousel 7. As FIG. 5 shows, each bin 40 is shaped like a slice of pie and may be of any suitable depth.

The means for effecting rotation of carousel 7 comprises a steel shaft 9 which is rigidly connected to the top of member 7A and is provided with a handwheel 10 which extends through an opening 10A in the side of cone housing H so that the operator can turn the carousel.

It is to be understood that helical screws (not shown) having sharpened outer blade edges could be used to replace the shaft/blade arrangement hereinbefore described.

The apparatus operates as follows. Containers C made of similar material are introduced into chamber 27A and motor 21 is energized to cause rotation of the blades 1. The blades exert opposing forces on any container therebetween and a container trapped between three sets of blades will be scored and cut by the sharp blade edges 1A. Blades on eccentric centers (or helical blades, if used) avoid any tendency for a round container to be merely spun around by the blades. An eccentric blade has a variable speed at its cutting edge and performs a cutting motion against a container C. With helical blades, the blade edges move at different angles when in contact with a container. Eccentric blades also produce a crushing effect, as well as a cutting action.

In the preferred embodiment the blades 1 are canted upward at about a 12 angle. One effect of this is to keep large shards in the cutting region of chamber 27A and allow only the small pieces to fall through the bottom opening 27C. In the embodiment disclosed all blades 1 rotate in the same direction but contra-rotation of sets of blades or individual blades in a set could be provided for. Five bins 40 on carousel 7, any one of which can be selectively moved below outlet 27C, enables specific materials being processed to be easily separated for easier recycling.

I claim:

1. Apparatus for cutting and breaking empty containers into small pieces of material comprising:

means including a wall defining a vertical open-ended tapered chamber having sloping sidewalls wider at the top than at the bottom and having a plurality of vertically and horizontally spaced slots disposed in said wall communicating with said chamber;

cutting blade means comprising a plurality of rotatable blade edge portions disposed on an axis substantially parallel with said sloping sidewalls and extending through said slots into said chamber for engagement with a container therein; and means to effect rotational movement of said blade edge portions to effect cutting and breaking of a container engaged therewith into small pieces of material.

2. Apparatus according to claim 1 wherein at least some of said cutting blade edge portions are arranged in opposing relationship so as to trap and cut containers therebetween.

3. Apparatus according to claim 2 wherein at least some of said blade edge portions disposed in opposing relationship rotate in irregular paths relative to one another.

4. Apparatus according to claim 1 wherein said blade edge portions are substantially perpendicular to said sloping sidewalls.

5. Apparatus for cutting and breaking empty containers into small pieces of material comprising:

means defining a chamber which tapers downwardly from a large upper inlet opening to a small lower outlet opening;

said chamber having a wall surface provided with a plurality of slots communicating with said chamber;

said slots being arranged in radially spaced apart columns and the slots in each column being vertically spaced apart from one another;

a plurality of rotatable cutting blades each having a cutting edge portion projecting through a slot into said chamber and being rotatable in a plane transverse to said wall surface; and means to effect rotation of said cutting blades so that a container descending through said chamber can be engaged, scored, cut and broken into small pieces of material between opposing cutting blade edges and between cutting blade edges and opposing side wall surfaces.

6. Apparatus according to claim 5 wherein the cutting blades in a column comprise disc-like members rigidly mounted in axially spaced apart relationship on a rotatable shaft.

7. Apparatus according to claim 6 wherein said disc-like members are eccentrically mounted on said shaft.

8. Apparatus according to claim 5 further including a selectively positionable rotatable member disposed near said lower outlet opening, said member having a plurality of compartments for receiving small pieces of material discharged from said lower outlet opening.

9. Apparatus according to claim 5 further comprising a bin disposed adjacent to and communicating with said upper inlet opening and movable between a first position in which containers may be placed into said bin through an opening in said bin and in which said upper inlet opening is blocked and a second position in which said bin opening communicates with said upper inlet opening for dumping containers into said chamber and in which access to said bin is blocked.

* * * * *